US007661639B2

(12) United States Patent
Jackson

(10) Patent No.: US 7,661,639 B2
(45) Date of Patent: Feb. 16, 2010

(54) APPARATUS FOR DISPLAYING ORNAMENTAL OBJECTS

(75) Inventor: Jeffrey Jackson, P.O. Box 97, Tybee Island, GA (US) 31328

(73) Assignee: Jeffrey Jackson, Bon Aqua, TN (US)

( * ) Notice: Subject to any disclaimer, the term of this patent is extended or adjusted under 35 U.S.C. 154(b) by 0 days.

(21) Appl. No.: 10/816,097

(22) Filed: Apr. 1, 2004

(65) Prior Publication Data

US 2004/0188032 A1 Sep. 30, 2004

Related U.S. Application Data

(63) Continuation-in-part of application No. 10/346,153, filed on Jan. 16, 2003, now Pat. No. 6,848,660.

(51) Int. Cl.
*A47G 29/00* (2006.01)
*A47F 5/00* (2006.01)

(52) U.S. Cl. ..... 248/215; 211/106.01; 248/316.7; 248/339; 248/498

(58) Field of Classification Search ..... 248/205.1, 248/205.2, 205.3, 214, 215, 301, 304, 309.1, 248/316.7, 322, 915, 316.1, 339, 238.1, 348, 248/345, 497, 498; 211/86.01, 89.01, 106.01
See application file for complete search history.

(56) References Cited

U.S. PATENT DOCUMENTS

| | | | | |
|---|---|---|---|---|
| 514,222 | A | 2/1894 | Hall | |
| 1,496,388 | A | 6/1924 | Stern | |
| 1,501,807 | A | 7/1924 | Petschel | 211/30 |
| 1,566,982 | A | 12/1925 | Shee | 248/214 |
| 1,726,316 | A | 8/1929 | Saxton | 248/215 |
| 1,943,261 | A | 1/1934 | Knuston | 24/73 |
| 2,080,990 | A | 5/1937 | Weekley | 248/215 |
| 2,461,071 | A | 2/1949 | Mettenleiter | 248/227 |
| 2,472,058 | A | 6/1949 | Artley | 211/13.1 |
| 2,565,719 | A | 8/1951 | Church | 248/215 |
| 2,743,023 | A * | 4/1956 | Larson | 211/96 |
| 3,136,515 | A | 6/1964 | Potruch | 248/62 |
| 3,199,820 | A * | 8/1965 | Thompson | 248/222.41 |
| 3,260,489 | A | 7/1966 | Hentzi | 248/215 |
| 3,491,971 | A * | 1/1970 | Fisher | 248/65 |
| 3,907,118 | A * | 9/1975 | Pelavin | 211/113 |
| 4,065,090 | A | 12/1977 | Mauney | |
| D255,774 | S | 7/1980 | Soucy | D8/371 |
| 4,418,496 | A | 12/1983 | Koistinen | 47/41.12 |
| 4,667,910 | A | 5/1987 | Atterby et al. | 248/71 |
| 4,739,582 | A | 4/1988 | Cullinane | 47/41.12 |
| D300,792 | S | 4/1989 | Hutchins | D6/514 |
| 4,880,133 | A | 11/1989 | Cullinane | 220/85 |
| 4,887,785 | A | 12/1989 | Blaich | 248/339 |
| 4,979,712 | A | 12/1990 | Rios | 248/215 |

(Continued)

*Primary Examiner*—Amy J Sterling
*Assistant Examiner*—Tan Le
(74) *Attorney, Agent, or Firm*—Sheehan Phinney Bass + Green P.A.; Peter A. Nieves

(57) ABSTRACT

An apparatus for displaying an object on a structure is provided. Generally, the apparatus contains a holding portion that is fabricated so as to allow the apparatus to hold to the structure. The apparatus also contains a hook that is capable of allowing the object to be set thereon, and a central loop that is capable of allowing a second object to be situated therein.

4 Claims, 8 Drawing Sheets

U.S. PATENT DOCUMENTS

| | | | | |
|---|---|---|---|---|
| D321,795 | S | 11/1991 | Winston | |
| 5,073,993 | A | 12/1991 | Dewaal | |
| 5,094,417 | A * | 3/1992 | Creed | 248/215 |
| 5,141,192 | A * | 8/1992 | Adams | 248/231.81 |
| D353,790 | S | 12/1994 | Emalfarb et al. | D11/155 |
| D360,572 | S | 7/1995 | Adams | |
| 5,487,517 | A | 1/1996 | Smith | 248/215 |
| 5,613,656 | A | 3/1997 | Protz, Jr. | 248/74.2 |
| D447,936 | S | 9/2001 | Kacines | D8/394 |
| 6,311,851 | B1 | 11/2001 | Knudsen, Sr. et al. | 211/13.1 |
| 6,364,260 | B1 | 4/2002 | Lorincz et al. | 248/215 |
| 6,378,827 | B1 | 4/2002 | Kacines | 248/231.81 |
| 6,543,737 | B2 | 4/2003 | Decker et al. | 248/316.1 |
| 6,550,737 | B1 | 4/2003 | Sai et al. | |
| D478,805 | S * | 8/2003 | Winig et al. | D8/367 |
| 6,601,809 | B1 | 8/2003 | Gebrara | 248/229.16 |
| 6,835,452 | B1 * | 12/2004 | Hamerski | 428/343 |
| 6,848,660 | B2 * | 2/2005 | Jackson | 248/215 |
| 2002/0038844 | A1 | 4/2002 | Miller | |
| 2003/0222190 | A1 | 12/2003 | Masas | |
| 2004/0188032 | A1 * | 9/2004 | Jackson | 156/574 |

* cited by examiner

APPARATUS FOR DISPLAYING ORNAMENTAL OBJECTS

CROSS-REFERENCE TO RELATED APPLICATIONS

The present application is a continuation-in-part of U.S. patent application Ser. No. 10/346,153 filed Jan. 16, 2003, which is now U.S. Pat. No. 6,848,660, the entire disclosure of which is incorporated by reference.

FIELD OF THE INVENTION

The present invention generally relates to an apparatus for displaying objects. More specifically, the invention is related to an apparatus for hanging objects from a ledge such as, but not limited to, a banister.

BACKGROUND OF THE INVENTION

Typically, each year during the holiday season festive decorations are arranged on structures such as Christmas trees, fireplace mantles, and banisters. Typical methods used for arranging decorations on structures include the use of adhesive tape and fasteners, such as metallic ties.

As an example, when hanging garland from a banister, adhesive tape is typically used to wrap the garland and prevent displacement of the garland. When using adhesive tape, a piece of adhesive tape is cut and the garland is stuck to the banister by wrapping the adhesive tape around the banister with the garland there between. Unfortunately, removal of the adhesive tape and garland is tedious since the adhesive tape sticks to the banister. Therefore, when removing the adhesive tape and garland, the adhesive tape tends to stick to the garland, thereby resulting in a portion of the garland being removed with removal of the adhesive tape.

FIG. 1 is a schematic diagram illustrating garland 10 set upon a banister 12 via use of adhesive tape 14. As shown by FIG. 1, the adhesive tape 14 is wrapped around the banister 12 to hold the garland 10 in place on the banister 12. Of course, less adhesive tape 14 may be utilized so that the adhesive tape 14 is not wrapped entirely around the banister 12. Even if the adhesive tape 14 is not entirely wrapped around the banister 12, removal of the adhesive tape 14 from the banister 12 may cause damage to the garland 10 and/or the banister 12.

Unfortunately, the use of fasteners is quite tedious since fasteners are typically tied or placed every few feet to secure the garland 10 and provide an ornamental design. FIG. 2 is a schematic diagram illustrating garland 10 set upon a banister 12 via use of ties 20, such as metallic ties or plastic ties. As shown by FIG. 2, the tie 20 is wrapped around the banister 12 to hold the garland 10 in place on the banister 12. As mentioned above, an individual setting the garland 10 is encumbered by having to tie the garland 10 with a tie 20 every few feet. Setting the garland 10 on the banister 12 typically includes placing the garland 10 on the banister 12 in a desired arrangement and wrapping the tie 20 around the banister 12 to hold the garland 10 in place. When removing the garland 10 from the banister 12, the individual is required to find each individual tie 20 and unwrap each tie 20 prior to removal of the garland 10 from the banister 12.

Therefore, present systems for setting decorations on structures are tedious and potentially damaging to the structures on which the decorations are set upon.

SUMMARY OF THE INVENTION

Embodiments of the present invention provide an apparatus for displaying ornamental objects. Briefly described, in architecture, one embodiment of the apparatus, among others, can be implemented as follows. The apparatus contains a holding portion that is fabricated so as to allow the apparatus to hold a structure and a frictional element to enhance the apparatus holding of the structure. The apparatus also contains a hook that is capable of allowing the object to be set thereon, and a central loop that is capable of allowing a second object to be situated therein.

Other apparatuses and advantages of the present invention will be or become apparent to one with skill in the art upon examination of the following drawings and detailed description. It is intended that all such additional apparatuses and advantages be included within this description, be within the scope of the present invention, and be protected by the accompanying claims.

BRIEF DESCRIPTION OF THE DRAWINGS

The present invention will be more fully understood from the detailed description given below and from the accompanying drawing of the embodiments of the invention, which however, should not be taken to limit the invention to the specific embodiments enumerated, but are for explanation and for better understanding only. Furthermore, the drawings are not necessarily to scale, emphasis instead being placed upon clearly illustrating the principles of the invention. Finally, like reference numerals in the figures designate corresponding parts throughout the several drawings.

DETAILED DESCRIPTION

It should be noted that while the following description predominantly describes the arrangement of the present support for hanging ornamental objects (hereafter referred to as, "the support") on a banister, the support may be set upon other surfaces such as, but not limited to, a ledge, mantle, fireplace molding, chair molding, or any other surface for which the support is conformed during fabrication. Conforming of the support is further described below and at least partially illustrated in the accompanying figures.

Figure 1:
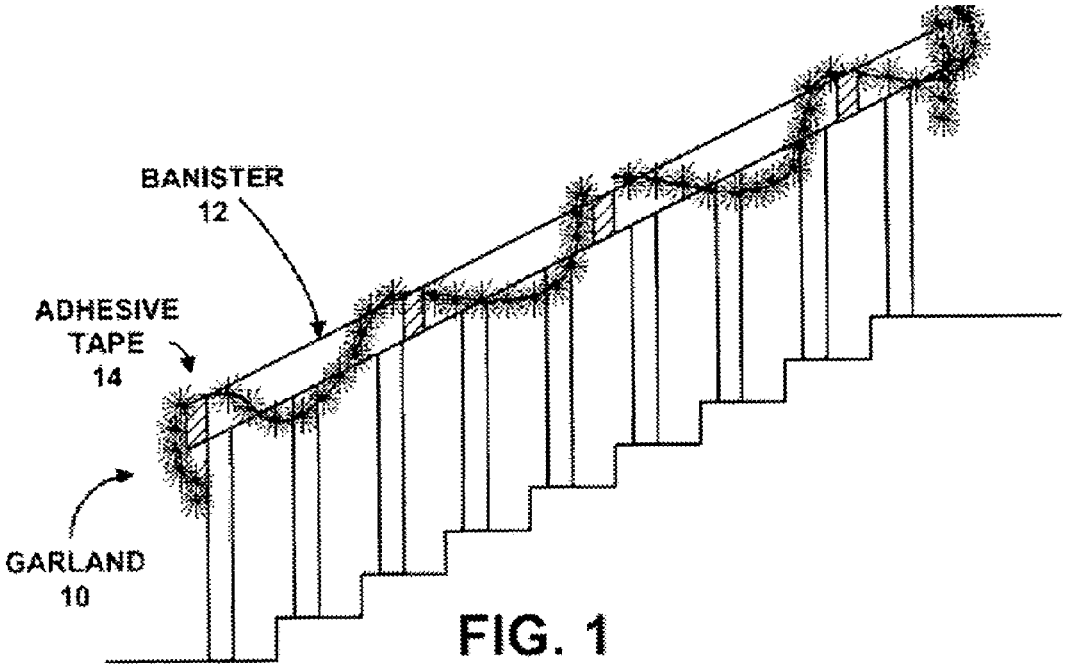
FIG. 1 (PRIOR ART)
FIG. 1 is a schematic diagram, illustrating garland set upon a banister via use of adhesive tape, in accordance with the prior art.
Figure 2:
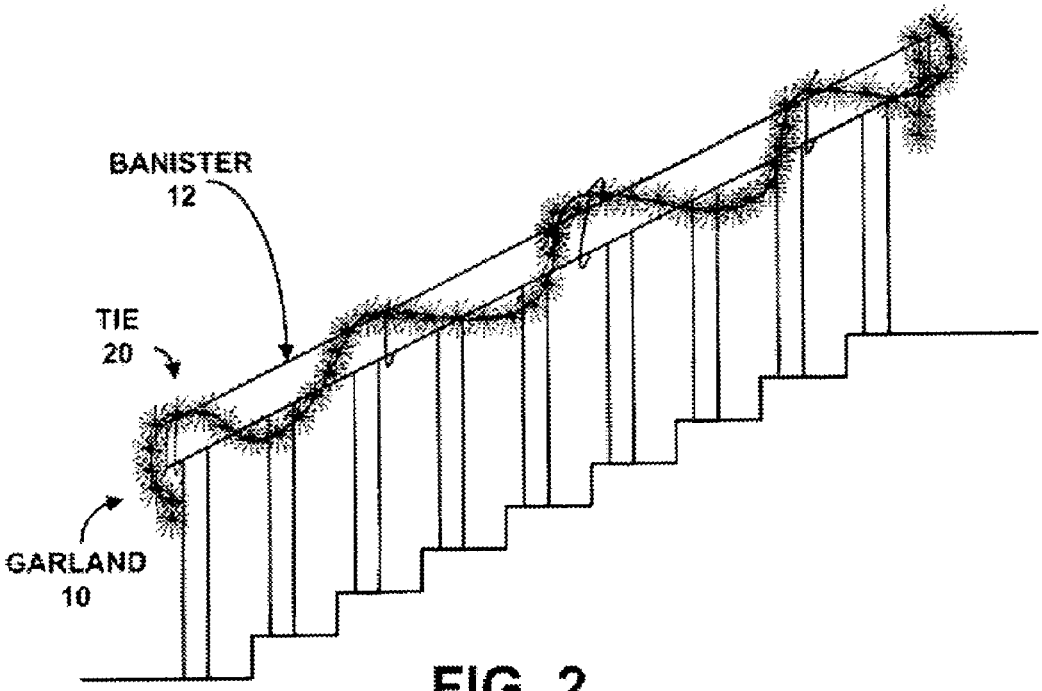
FIG. 2 (PRIOR ART)
FIG. 2 is a schematic diagram, illustrating garland set upon a banister via use of ties, in accordance with the prior art.
Figure 3:
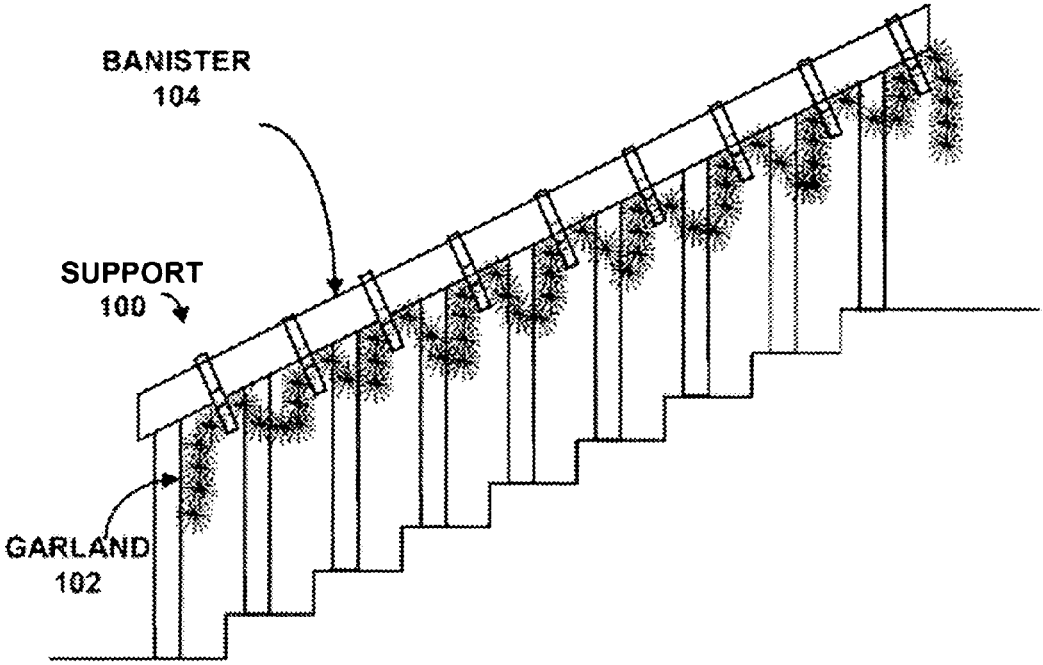
FIG. 3 is a schematic diagram, illustrating garland set upon a banister via use of a support, in accordance with a first exemplary embodiment of the invention.

Referring now to the drawings, wherein like reference numerals designate corresponding parts throughout the drawings, FIG. 3 is a schematic diagram illustrating use of the support 100 for arranging garland 102 on a banister 104. It should be noted that the support 100 may be utilized to arrange other objects as well, such as, but not limited to, ornaments, lights (described below), and bows (described below). For exemplary purposes, the present detailed description describes arranging of garland 102 on a banister 104.

As is shown by FIG. 3, the garland 102 hangs from the support 100, while the support 100 is set on the banister 104. In accordance with a first exemplary embodiment of the invention, the garland 102 hangs from a hook 122 (FIG. 6) of the support 100. To change hanging arrangement of the garland 102, additional or fewer supports 100 may be utilized.

Figure 4:
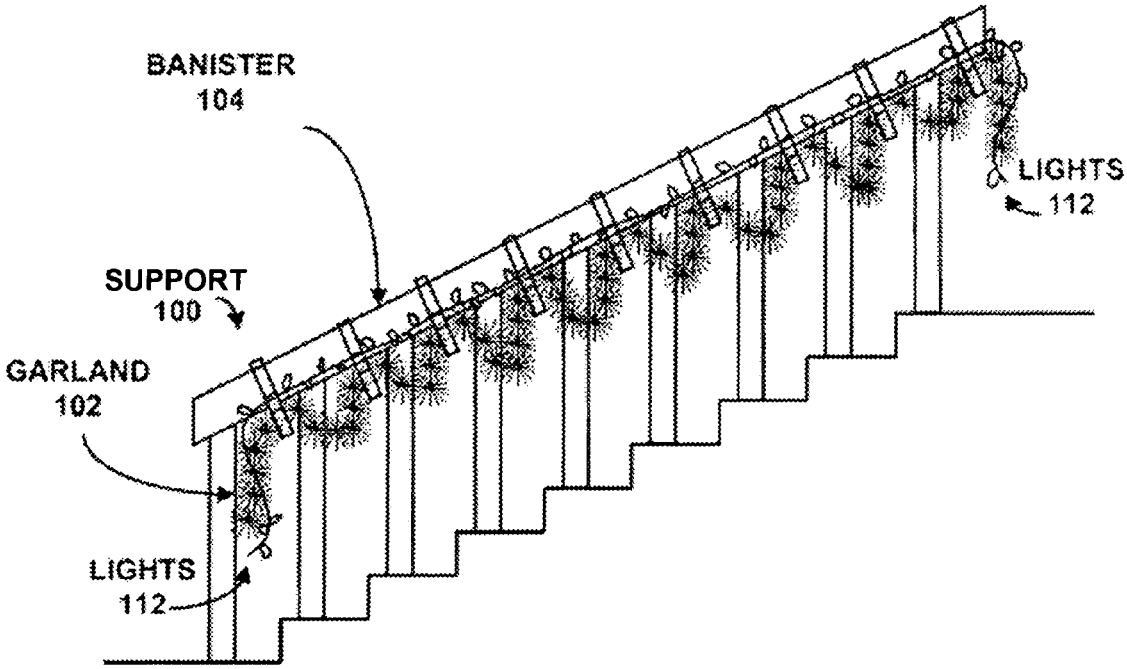
FIG. 4 is a schematic diagram, illustrating garland set upon a banister via use of the support of FIG. 3, wherein lights are arranged within the support.

The support 100 also contains a central loop 124 (FIG. 6) for running objects therein. As an example, lights 112 (FIG. 4) may be run through the central loop 124 (FIG. 6) of the support 100. The central loop 124 (FIG. 6) may also hold objects therein, as is described below. FIG. 4 is a schematic diagram illustrating garland 102 set upon the banister 104 via use of the support 100, wherein lights 112 are arranged within the support 100. Specifically, the lights 112 are arranged within the central loop 124 (FIG. 6).

Figure 5:
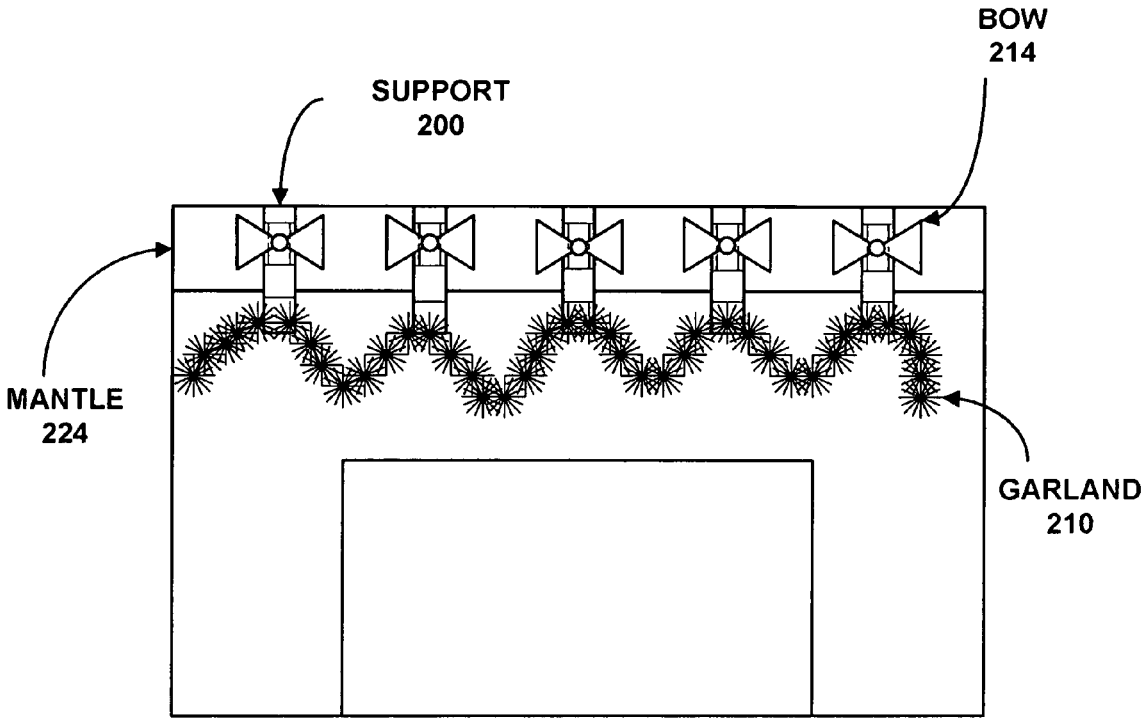
FIG. 5 is a schematic diagram, illustrating garland set upon a mantle via use of a support, in accordance with a second embodiment of the invention.
Figure 8:
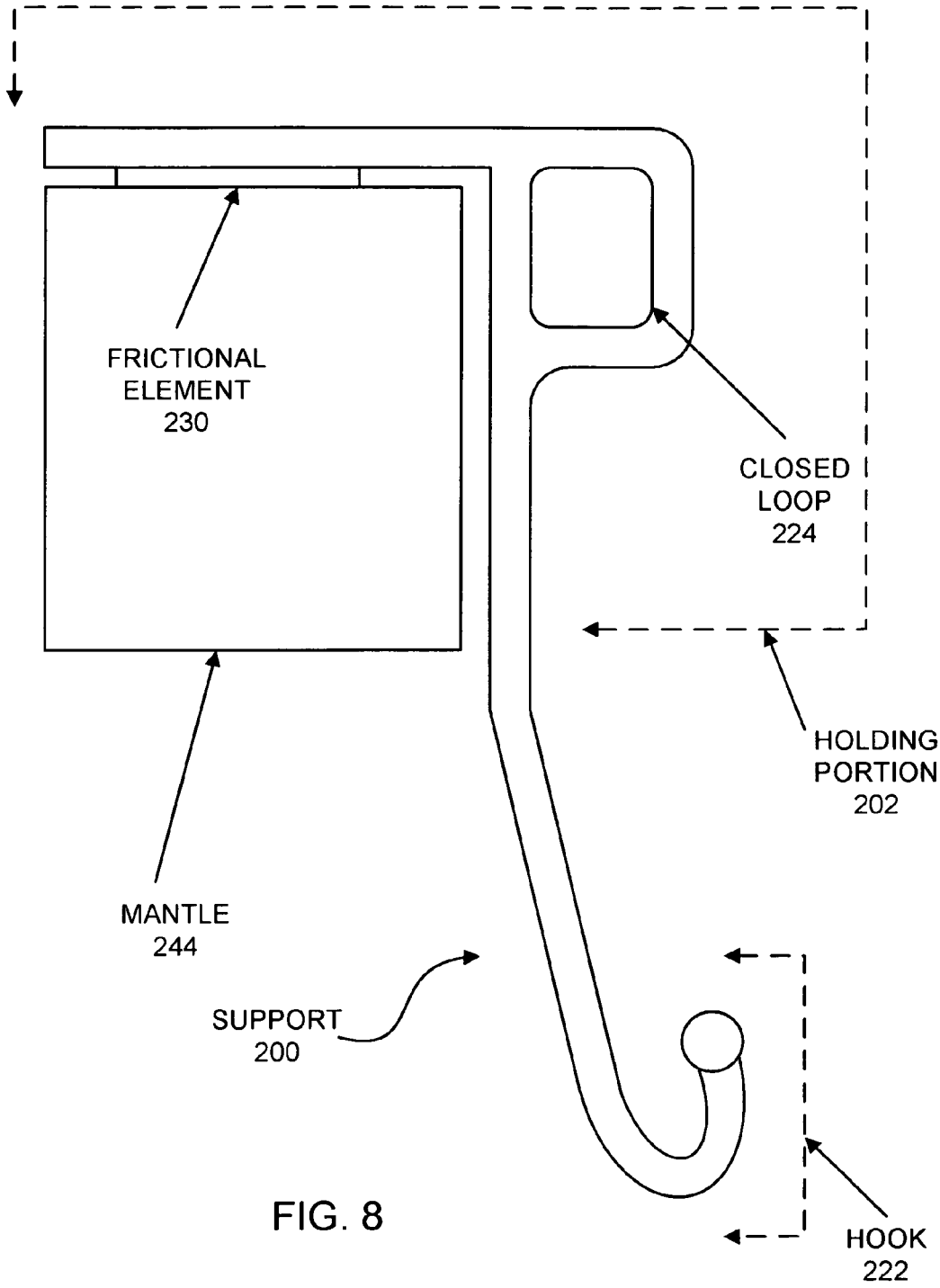
FIG. 8 is a side view of a support in accordance with the second exemplary embodiment of the invention, wherein the support is arranged on a mantle.
Figure 9:
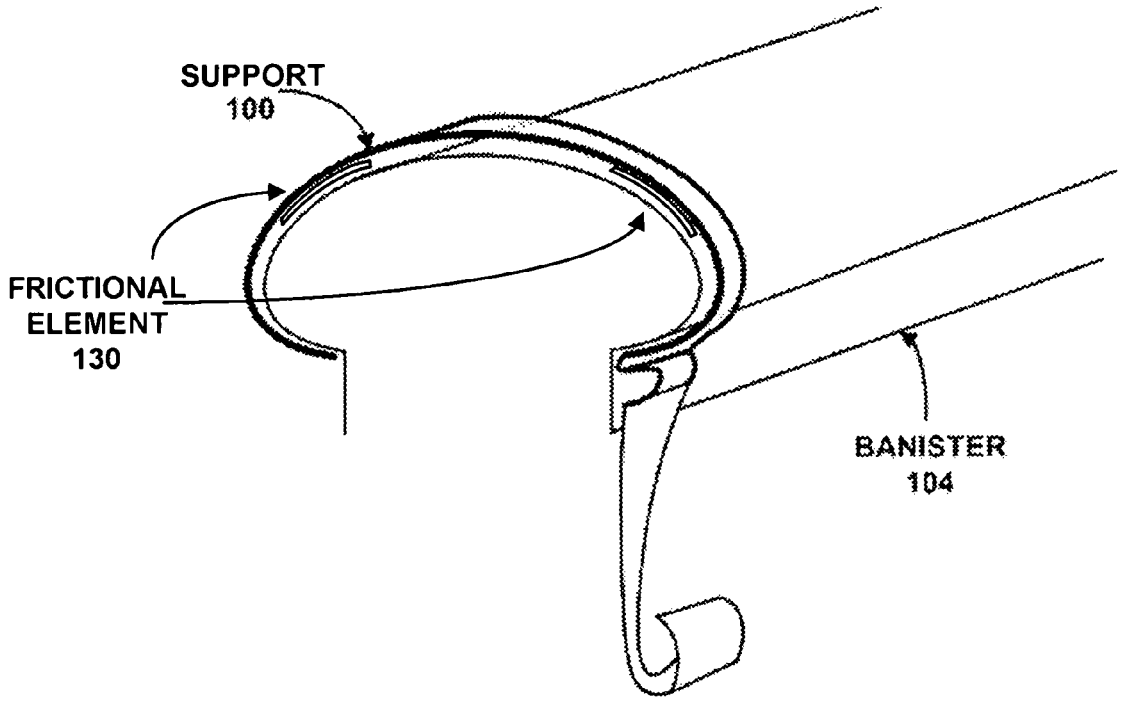
FIG. 9 is a side view of a support, formed to fit a banister, wherein the support has an elongated hook.

FIG. 5 provides a schematic diagram of a second exemplary embodiment illustrating garland 202 set upon the mantle 244 via use of the support 200, wherein a bow 214 is arranged within each support 100. The support 200 may simply rest upon the mantle 244, may be adhesively joined to the mantle 244 or may otherwise be joined to the mantle 244. If the support 200 is to simply rest on the mantle 244, additional weight may be added to the holding means, integrally, adjacently or otherwise, to allow the support 200 to rest securely. Specifically, a bow 214 is arranged within the central loop 224 (FIG. 8) of each support 200, in a manner similar to arrangement of the lights 212, as shown by FIG. 4. In fact, the central loop 224 (FIG. 8) of the support 200 may be utilized to hold different objects that fit therein. FIG. 8, which is described in detail below, better illustrates the central loop 224 (FIG. 8) of the support 200, as well as other portions of the support 200.

Figure 6:
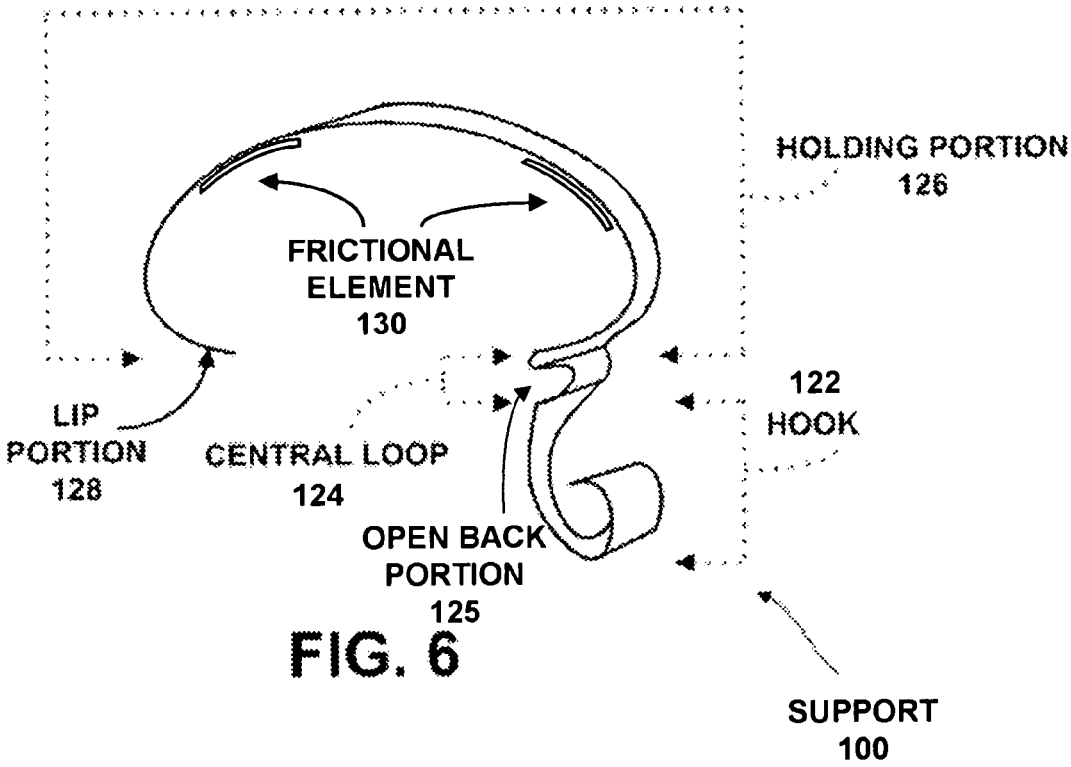
FIG. 6 is a side view of the support of FIG. 3, in accordance with the first exemplary embodiment of the invention.
Figure 7:
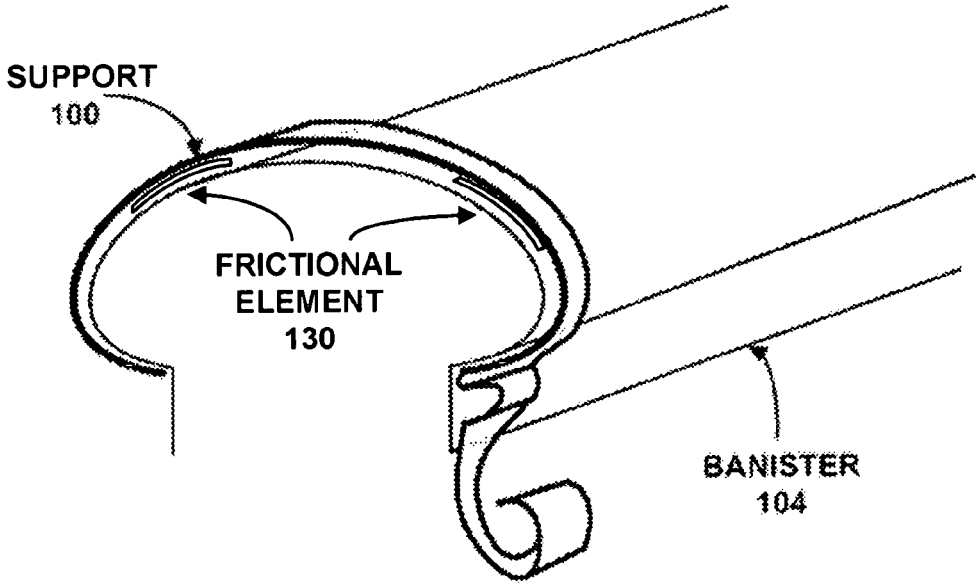
FIG. 7 is a side view of the support of FIG. 6, wherein the support is arranged on a banister.

Turning now to FIG. 6, the support 100 contains the hook 122, the central loop 124, and a holding portion 126. In addition, the holding portion 126 further comprises a lip portion 128. The holding portion 126 of the support 100 is shaped so as to conform to a structure, such as, but not limited to, the banister 104 or the mantle 144, thereby allowing the holding portion 126 to hold to the structure. Specifically, the holding portion 126 is flexible, yet sturdy enough to conform to its originally fabricated shape. Therefore, a force may be provided to the lip portion 128 of the holding portion 126 so as to flex the lip portion 128 in a direction away from the hook 122. The support 100 may then be situated on the banister 102, as shown by FIG. 7. However, after the force is removed from the lip portion 128, the holding portion 126 conforms back to the originally fabricated shape so that the support 100 holds to the banister 104. As an example, the entire holding portion 126 may fit snugly to the structure, wherein minimal space exists between the structure and the holding portion 126. Alternatively, a portion of the holding portion 126 may fit snugly to the structure, while other portions of the holding portion 126 have a minimal amount of space between the portions and the structure.

As shown in FIG. 6, the holding portion 126 also includes a frictional element 130. The frictional element 130 could be an adhesive pad, a thin, rubber pad, double-sided tape, double-sided foam mounting tape, or other, similar device known to those with skill in the art. The frictional element 130 is useful for maintaining a position of the support 100 on a banister 104, impeding the support 100 from sliding on the banister 104. The frictional element 130 may also be useful in securing the support 100 to a mantle (244, as shown in FIGS. 5 and 8), or similar structures, where the holding portion 126 cannot snugly grip the structure. The frictional element 130 is located between the holding means 126 and the banister 104 or other structure. The holding means 126 may further contain recesses to receive the frictional element 130, particularly if the frictional element 130 has significant thickness.

The support 100 may be made of different materials, such as, but not limited to, plastic and/or metal, as long as the holding portion 126 of the support 100 may be flexed to allow a structure, such as the banister 104, to fit therein. It should be noted that the holding portion 126 of the support 100 may also be shaped differently during fabrication so as to conform to the shape of the structure on which the support 100 is to be set. As an example, FIG. 8 is a side view of a support 200 in accordance with a second exemplary embodiment of the invention, wherein the support 200 is set upon a mantle 244. As is shown by FIG. 8, a holding portion 202 of the support 200, in accordance with the second exemplary embodiment of the invention, is square-like in shape so as to allow the holding portion 202 of the support 200 to hold the mantle 244.

Returning to FIG. 6 and FIG. 7, the hook 122 of the support 100 may be larger or smaller than the size illustrated by FIGS. 3-7. Specifically, the hook 122 may be fabricated to hold large ornamental objects or small ornamental objects on the support 100. The size of the hook 122 may also be determined based upon a desired distance between the banister 104 and the garland 102 being hung. As an example, if the user of the support 100 wishes for the garland 102 to be situated close to the banister 104, the support 100 used by the user would have a short hook 122 (i.e., FIG. 7). Alternatively, if the user of the support 100 wishes for the garland 102 to be a further distance to the banister 104, the support 100 used by the user would have an elongated hook 122. FIG. 8 is a schematic diagram illustrating an elongated hook 222.

Returning to FIG. 6 and FIG. 7, during fabrication of the support 100, the hook 122 may be fabricated so that a distance between the lip portion 128 and the central loop 124 is slightly smaller than the width of the banister 104 on which the support 100 is to be set. Therefore, after setting the support 100 on the banister 104, the support 100 attempts to conform back to its originally fabricated shape, thereby providing enough pressure on the banister 104 so as to ensure that the support 100 maintains its position on the banister 104.

After the support 100 has been situated on the banister 104, the support 100 may be removed by pulling the hook 122 of the support 100 away from the banister 104 and then lifting upward. Alternatively, the user of the support 100 may lift the hook 122 of the support 100 upward to remove the support 100 from the banister 104.

The central loop 124 of the support 100 may be sized so as to allow larger or smaller objects to be fit therein, or run there through. As an example, as has been mentioned herein-above, lights may be run within the central loop 124. If lights are run within the central loop 124, the size (i.e., diameter) of the central loop 124 may be relatively small. Alternatively, if a large bow is to be set in the central loop 124, the size of the central loop 124 may be relatively large. It should be noted that the central loop 124 described herein-above has an open back portion that allows an object, such as the lights, to be easily set therein.

Figure 10:
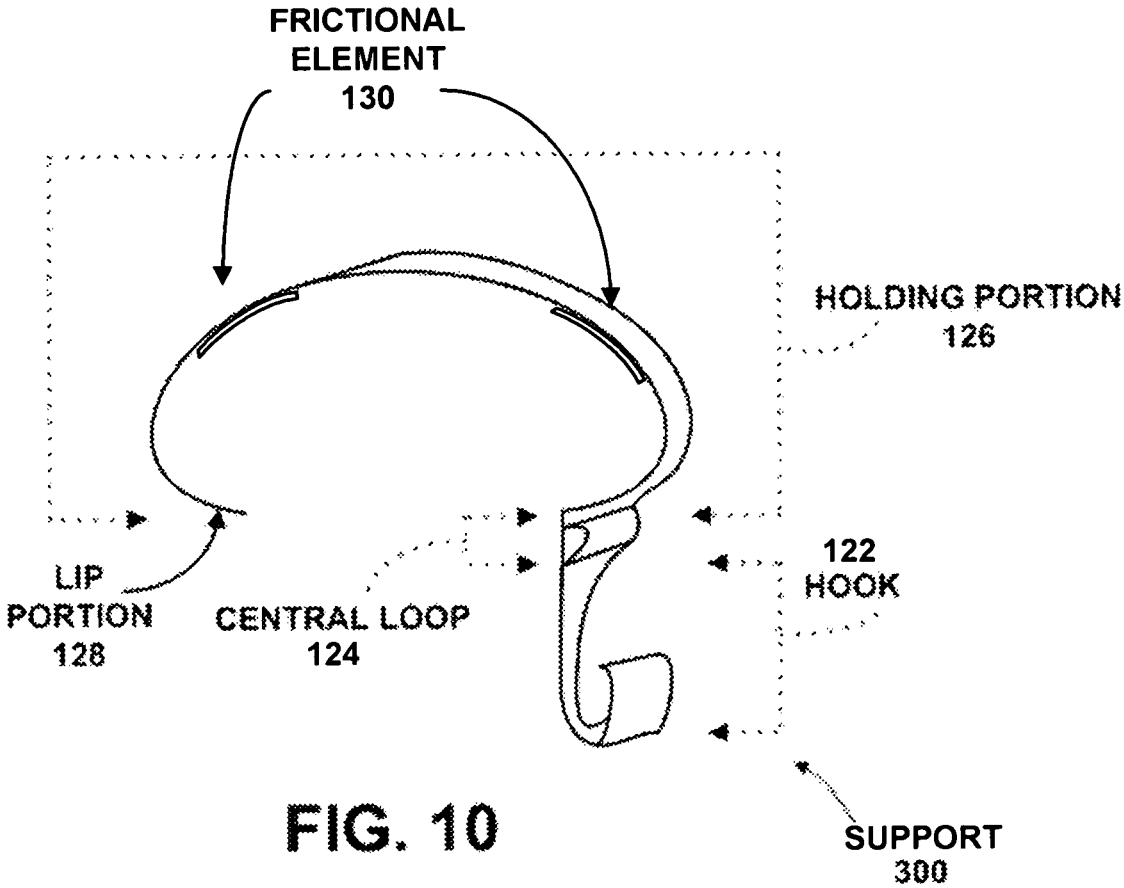
FIG. 10 is a side view of a support in accordance with a third exemplary embodiment of the invention.

FIG. 10 is a side view of a support 300 in accordance with the third exemplary embodiment of the invention. In accordance with a third exemplary embodiment of the invention, the central loop 124 does not have an open back portion.

Figure 11:
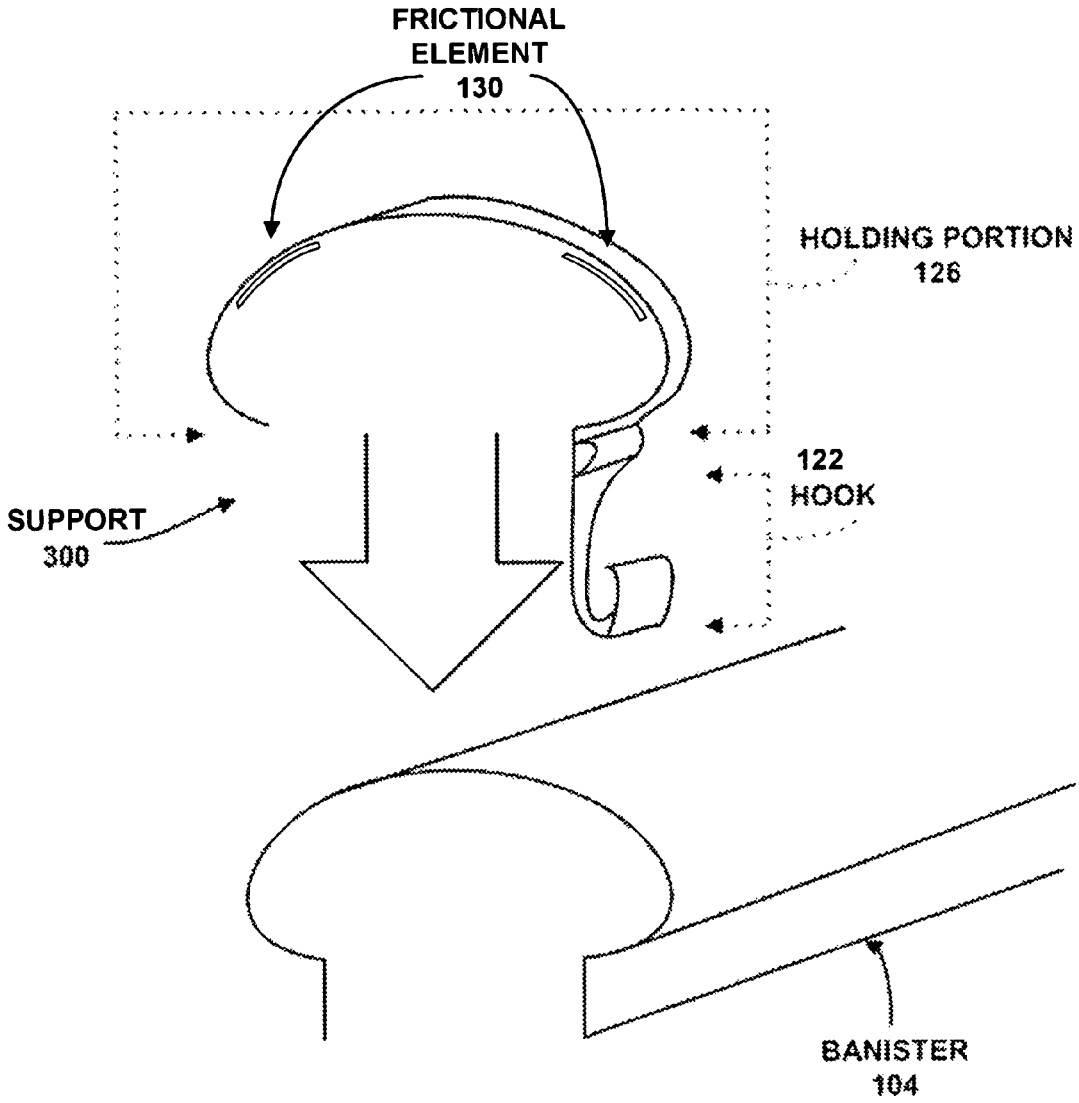
FIG. 11 is a schematic diagram, illustrating a procedure for setting the support of FIG. 10 on a banister.

FIG. 11 is a schematic diagram illustrating a procedure for setting the support 300 of FIG. 10 on the banister 104. It should be noted that the procedure illustrated by FIG. 11 may be utilized to set any of the above-mentioned supports 100, 200 on the banister 104. As is shown by FIG. 11, the support 300 is pushed downward, onto the banister 104. After contacting the banister 104, forcing the support 300 downward results in the hook 122 and holding portion 126 widening to allow the banister 104 to sit therein. When the banister 104 is seated within the holding portion 126, the holding portion 126 holds to the banister 104, thereby preventing the support 300 from sliding up and down the banister 104.

It should be noted that each support demonstrated by the above-mentioned embodiments, contains a smooth inner portion, wherein it is the inner portion of a support that touches a banister 104. The smooth inner portion prevents the banister 104 from being scratched either during placing the support on the banister, during removal of the support from the banister 104, or while the support sits on the banister 104. The frictional element 130 may further contribute to protection of the banister 104, as it may offset the holding portion 126 from the banister 104.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

I claim:

1. An apparatus for displaying one or more objects on a structure, the apparatus comprising:

a holding portion permitting the apparatus to be mounted to the structure, wherein the holding portion is in the shape of an upside-down L having an elongated horizontal portion that meets an elongated vertical portion of the holding portion at approximately ninety degrees;

an enclosed central loop permitting display of a second object, the enclosed central loop having a top portion, a bottom portion, a front portion, and a back portion, wherein the top portion horizontally meets the elongated horizontal portion of the holding portion so that the top portion of the enclosed central loop and the elongated horizontal portion of the holding portion make one elongated horizontal surface, the enclosed central loop being enclosed on the top portion, the bottom portion, the front portion, and the back portion of the enclosed central loop, the enclosed central loop being open on a left side portion and a right side portion of the enclosed central loop so as to allow the second object to be situated therein, and the back portion of the enclosed central loop being a portion of the elongated vertical portion of the holding portion, and a hook permitting display of a first object, the hook being an extension of the back portion of the enclosed central loop, and the hook being open in a vertically upward direction so as to allow the first object to be retained thereon by means of gravity, wherein the holding portion has a frictional element capable of reducing mobility in the horizontal direction, the frictional element being present only on a vertically downward-facing surface of the elongated horizontal surface of the holding portion, the vertically downward direction being substantially opposite the vertically upward direction; and wherein a proximate portion of the hook, being proximate to the back portion of the enclosed central loop, is bent relative to the elongated vertical portion of the holding portion such that an imaginary line is a direction extending the proximate portion of the hook would form an obtuse angle with the elongated horizontal surface of the holding portion.

2. The apparatus of claim 1, wherein the frictional element further comprises a two-sided adhesive tape.

3. The apparatus of claim 1, wherein the frictional element further comprises a thin, rubber pad.

4. The apparatus of claim 1, wherein the holding portion, the enclosed central loop, and the hook are a single solid structure.

* * * * *